US005231721A

United States Patent [19]

Fish

[11] Patent Number: 5,231,721

[45] Date of Patent: Aug. 3, 1993

[54] REMOVABLE BEDSIDE GRAB BAR (POST)

[76] Inventor: Michael Fish, 1500 Pine Park Ave., Lakewood, N.J. 08701

[21] Appl. No.: 923,566

[22] Filed: Aug. 3, 1992

[51] Int. Cl.[5] ..... A47C 21/00

[52] U.S. Cl. ..... 5/662; 5/424; 5/503.1

[58] Field of Search ..... 5/424, 425, 507.1, 658, 5/662, 503.1

[56] References Cited

U.S. PATENT DOCUMENTS

| | | | |
|---|---|---|---|
| 2,648,850 | 8/1953 | Warren | 5/425 |
| 3,176,322 | 4/1965 | Mulcahy | 5/503.1 |
| 3,310,817 | 3/1967 | Harding | 5/662 |
| 3,863,282 | 2/1975 | Stillwell | 5/503.1 |
| 4,932,090 | 6/1990 | Johansson | 5/662 |

FOREIGN PATENT DOCUMENTS

| | | | |
|---|---|---|---|
| 2500743 | 9/1982 | France | 5/662 |
| 8202832 | 9/1982 | PCT Int'l Appl. | 5/662 |

*Primary Examiner*—Michael F. Trettel

*Attorney, Agent, or Firm*—Henry I. Schanzer; Michael Y. Epstein

[57] ABSTRACT

A bedside grab bar or post for better enabling infirm persons to get into and out of a bed without assistance. The grab bar is in the shape of an inverted U including two vertical legs removably attachable to a bed side rail. The grab bar may be disposed along the length of the bed at an adjustable distance from the head of the bed to accommodate the user of the bed and has a relatively small width, thereby leaving ample space for movement onto and off the bed in the open space between the grab bar and the bottom end of the bed and without movement of the grab bar.

5 Claims, 3 Drawing Sheets

REMOVABLE BEDSIDE GRAB BAR (POST)

BACKGROUND OF THE INVENTION

This invention relates to beds, and particularly to bedside grab bars or posts by means of which users of the beds can assist themselves getting in and out.

A problem for some infirm persons, particularly those who are not receiving extensive or full time assistance, as in a hospital, is getting into and out of a bed by themselves. This problem is frequently encountered in retirement and nursing homes, for example, where the residents are fit enough to generally fend for themselves but are generally relatively weak and somewhat incapacitated. The problem is also encountered by the elderly residing in their own homes. I have observed that, in many instances, the addition of some sort of hand post or rail on or near the bed would be of great use for enabling an enfeebled person to get into and out of bed without assistance.

The use of bed gates which can be used as hand holds is well known. Hospital beds, for example, typically include such gates which, however, are used primarily to prevent patients from falling out of bed. As such, the gates extend substantially the full lengths of the beds and include relatively complex mechanisms allowing retraction of the gates by a person assisting the patient. Because of the complexity and extend of such gates, they tend to be quite expensive as well as not serving the above-described self-assistance function.

Similarly, rails are used in bunk beds and the like. Again, these rails are primarily for retaining the user within the bed and, because they are disposed generally along a central portion of the bed, require same degree of agility by a person getting into and out of the bed and around the bed rail.

A need exists, therefore, for a bedside post whose position along the length of a bed may be adjusted to accommodate the user. The bedside post is preferably located adjacent to one end, preferably the head end, of the bed, which post is fixedly positioned, thereby requiring no manipulation either by the user or an assistant, and not interfering with movements of the user onto or off the bed.

SUMMARY OF THE INVENTION

A removable bedside grab bar, or post, is provided for a bed including a frame having side rails, head and bottom ends. The position of the grab bar along the length of the bed is adjustable to accommodate the user of the bed. Once positioned in place, the grab bar is fixedly mounted on the frame. The grab bar includes a hand post in the shape of an inverted U including two vertical legs attached to one of the frame side rails.

In a preferred embodiment, removable clamps are rigidly secured to the frame side rail and include mounting means, such as C-shaped clamps through which the vertical legs of the grab bar can pass, allowing simple mounting and removal of the grab bar from the bed. The grab bar legs extend beyond the bed rail and rest on the floor for greater rigidity of the grab bar and, if desired, the legs can be fastened to the floor.

DESCRIPTION OF PREFERRED EMBODIMENTS

Figure 1:
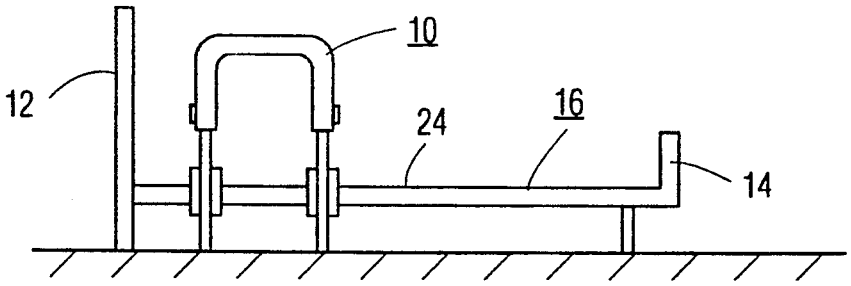
FIG. 1 is a side elevation, schematic view of a bed including a hand grab bar or post according to this invention.

FIG. 1 shows, schematically, a bed including a hand post 10 according to this invention. By way of example, the bed has a length of 6 feet and the post 10 is spaced a distance of 1.5 feet from the head end 12 of the bed. The post 10 has an inverted U-shape, with the width of the post, along the length of the bed, being 8 to 12 inches. This leaves a space of around 3.5 feet between the post 10 and the bottom end 14 of the bed providing ample room, without requiring movement of the post 10, for movement of a user onto and off the bed. In this embodiment, the height of the post above the frame 16 of the bed is around 2 feed. The vertical legs of the post 10 preferably extend below the bed frame and rest on the floor to support the weight of the post 10. This reduces stresses both on the bed frame and the means for securing the post 10 to the frame. Also, the legs can be secured to the floor as by screws.

While the post 10 can be permanently attached to the bed, in a preferred embodiment, the post is removably attached to the bed by clamping means. This provides advantages that the position of the post along the length of the bedside rail can be changed as may be desirable, and that the post can be easily added to an otherwise conventional bed without modification of the bed structure and without damage thereto.

Figure 3:
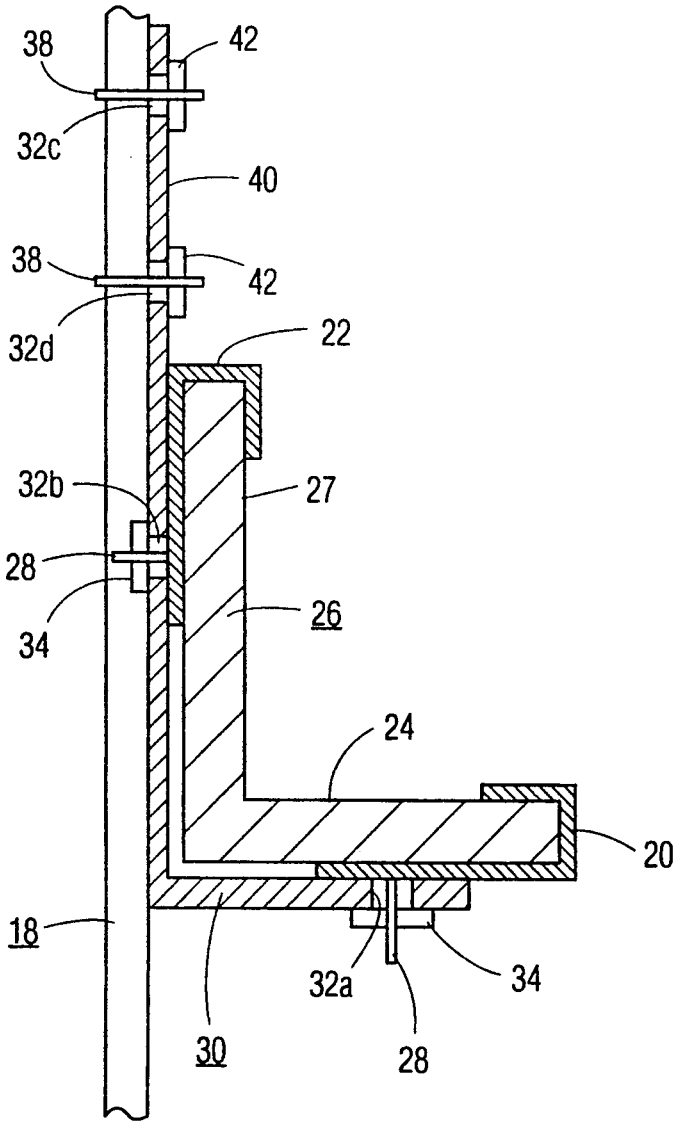
FIG. 3 is a cross-sectional view taken along line 3—3 of FIG. 2.
Figure 2:
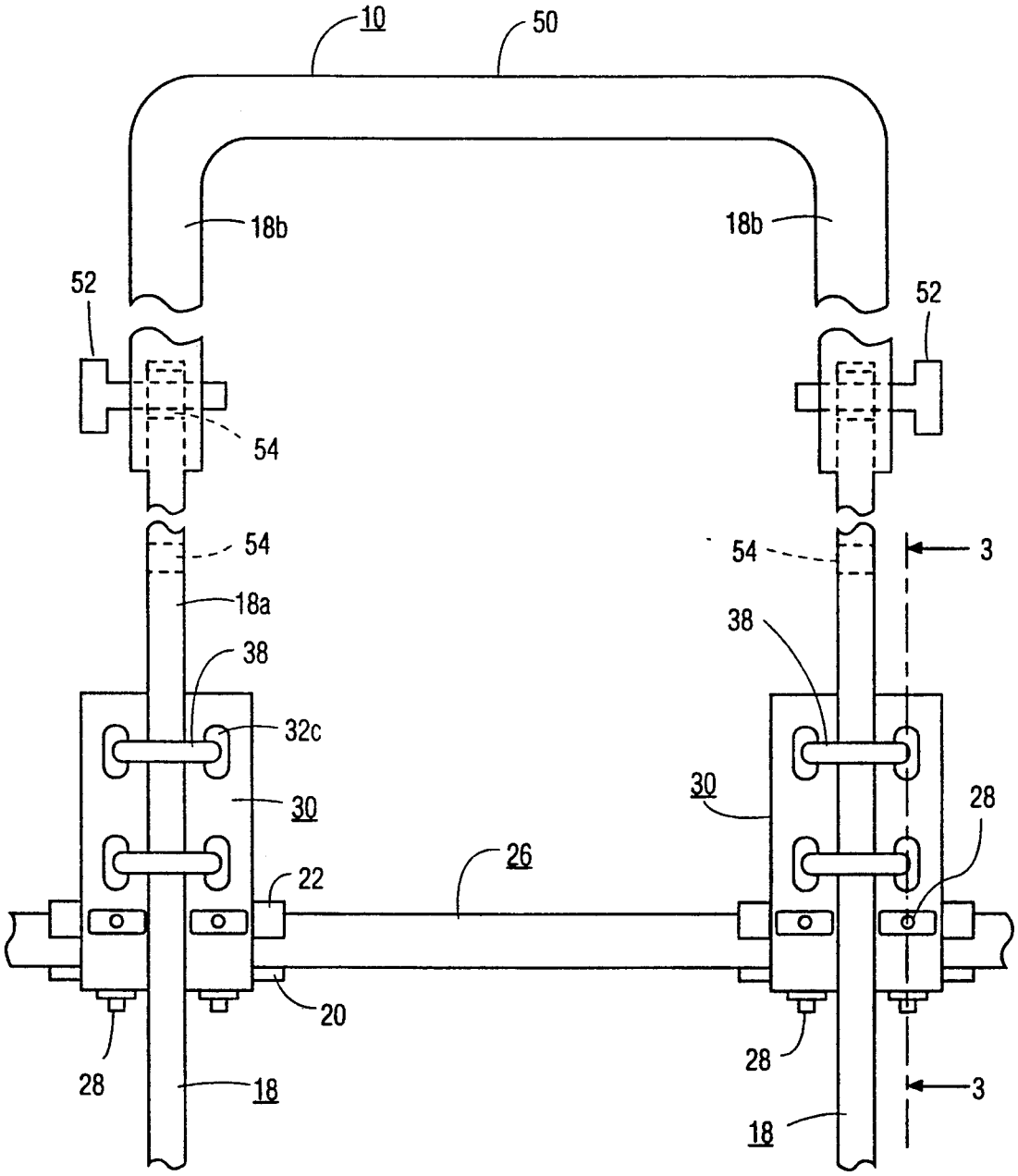
FIG. 2 is a front elevation and partial view of the post shown in FIG. 1 showing how it is mounted on a rail of the bed.

With reference to FIGS. 2 and 3, the post 10, as previously described, includes two vertical legs 18 and mounting means for securing each leg to a bed side rail 26. In this embodiment, the bed side rail 26 is of metal and has, as is common, an L-shaped cross-section. Other beds having different types of side rails can be used with the bedposts of the invention.

The mounting means comprises two pairs of U-shaped clamps 20 and 22, the clamps 20 being force fitted onto the horizontal wall 24 of the L-shaped side rail 26 of the bed frame, and the clamps 22 being force fitted onto the vertical wall 27. Each clamp 20 and 22 includes a pair of rigidly attached outwardly extending screws 28. The clamps 20 and 22 can have horizontal lengths, for example, of 8 inches and are made of ¼ inch thick metal plates.

Two L-shaped supports 30 each having 4 pairs of elongated slits 32*a–d* therethrough are mounted one each on each pair of clamps 20 and 22. This is done by threading the clamp screws 28 through the slit pairs 32*a* and 32*b* of the supports 30 and bolting the supports 30 to the clamps by means of wing nuts 34.

Each of the supports 30 includes two C-clamps 38 projecting from the vertical wall 40 of the supports through the wall slits 32*c* and 32*d* and held in place by wing nuts 42. The vertical legs 18 of the hand post 10 pass through the C-clamps 38 and are clamped in place by tightening the nuts 42. Preferably, the ends of the legs 38 extend downwardly past the bed side rail 26 and rest on the floor.

The U-shaped post 10 can comprise a single bar of metal or, preferably, three members, e.g., two legs 18

(FIG. 2) which comprise straight rods 18*a* having upper ends at a height of about 1 foot over the rail 26, and a U-shaped tubular member 50 having vertical legs 18*b* which are telescoped onto the rods 18*a*. The legs 18*b* are held in place by means of known type spring biased pins 52 which are biased to extend through openings 54 through the rods 18*a*. The openings 54 are spaced along the lengths of the rods 18*a*, whereby the height of the U-shaped post 10 is readily adjustable. The post U-shape bar or bars can comprise aluminum tubing of ¾ inch diameter and 3/16 inch wall thickness.

The described combination of bed and bedpost satisfies the afore-described needs. The post can remain fixed in place, thus not requiring manipulation by the bed occupant or an assistant, while not interfering with movements onto and off the bed. The hand post 10 is adjustable with respect to its position along the bed and to its height, and is readily removable from the bed. For example, while leaving the supports 30 in place, the post 10 can be readily removed to simplify making the bed, e.g., changing the bed sheets. Similarly, while leaving the clamps 20 and 22 in place, the supports 30 can be removed for moving or replacing a mattress supported by the bed frame. Also, the post 10 and its mounting means can be added to or removed without modification of otherwise conventional beds and without damage to the beds.

Figure 4:
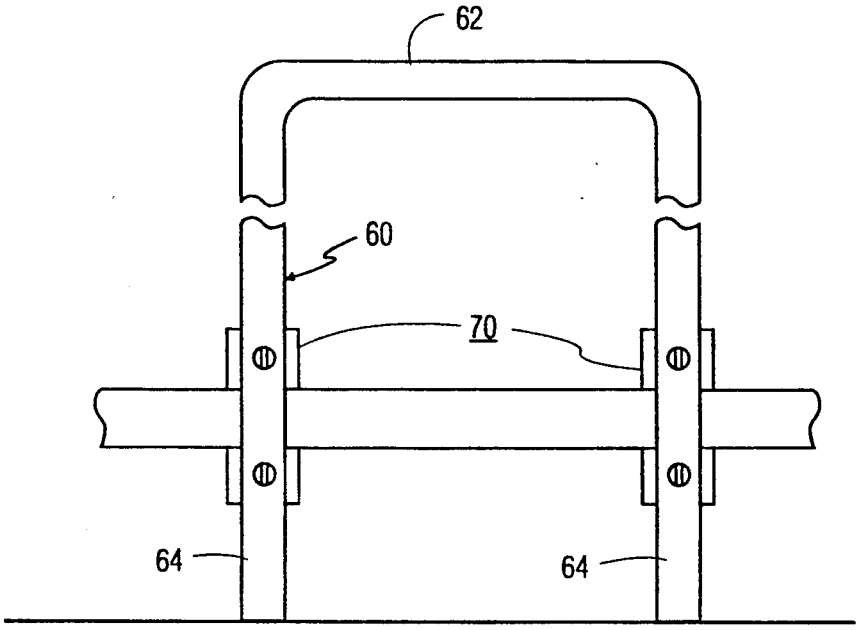
FIGS. 4 and 5 are views similar to FIGS. 2 and 3, respectively, showing another embodiment of the invention.
Figure 5:
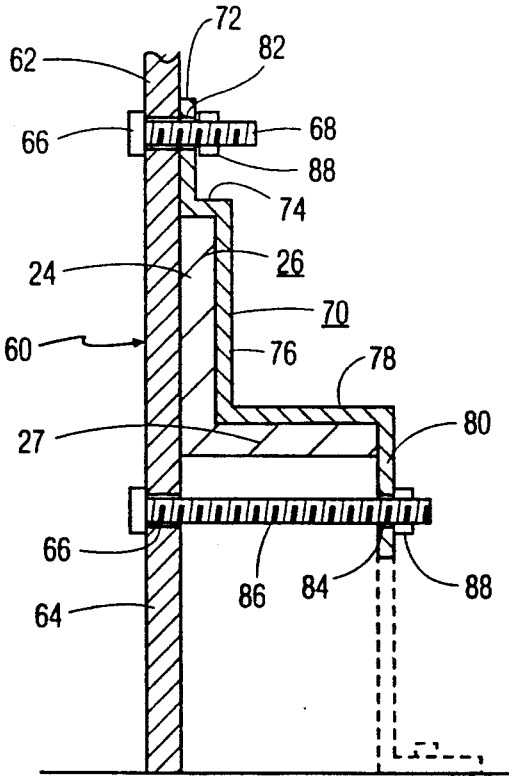

Another embodiment of a grab bar or post according to this invention is shown in FIGS. 4 and 5.

In this embodiment, the grab bar 60 comprises a U-shaped bar 62 (of one or more parts as in the embodiment illustrated in FIGS. 1–3) including two vertical legs 64. Each leg has two openings 66 therethrough by means of which the legs can be secured, by screws 68, to the bed frame side rail 26 by means of a single piece clamping member 70.

In this embodiment, the clamping members 70 each comprises an elongated metal strip, e.g., of 2 inches width and ¼ inch thickness, having a number of right angle bends, as shown in FIG. 5, providing a number of sections 72, 74, 76, 78 and 80. The two adjoining sections 76 and 78 have an L-shape conforming to the cross-sectional shape of the frame side rail 26 and, in use, are clamped against the vertical and horizontal ledges 24 and 27 of the rail 26. The section 74 (which can be omitted) interconnects the section 76 to a section 72 having an opening 82 therethrough, and the section 78 is connected to a section 80 having an opening 84 therethrough.

In use, each clamp 70 is held in place against the bed side rail 26 and the legs 64 are secured thereto by means of the screws 68 and 86 which are passed through the respective openings 66, 82 and 84 and tightened in place by nuts 88.

For greater rigidity of the grab bar 60, the sections 80 of the clamping means 70 can extend, as shown by dashed lines, in parallel to the legs 64, to the floor. Also, by means of an additional bend at the lower end of the sections 80, horizontal sections can be provided for securing the sections to the floor.

Although various dimensions and materials are described by way of example, persons of skill in these arts can readily select other materials and dimensions for providing grab bars or posts in accordance with this invention.

What is claimed is:

1. A bed comprising a frame having side rails, head and bottom ends, and legs for supporting the side rails above a floor supporting the bed, and a bedside post having the shape of an inverted U including two vertical legs attached to one of said rails, said post being spaced from said head end a distance which is selectable and adjustable to accommodate a user of the bed and having a width along the bed length which is a small portion of the length of the bed leaving sufficient space between said bottom end and said bedside post for enabling entry and exit from the bed without movement of said post, and including C-clamp means secured to said one rail, the vertical legs of said post extending through said clamp means for releasingly securing said legs to said one rail, and said legs extending downwardly past said one rail and having ends resting on and supported by the floor.

2. A bed comprising a frame having side rails, head and bottom ends, and legs for supporting the side rails above a floor supporting the bed, and a bedside post having the shape of an inverted U including two vertical legs attached to one of said rails, said post being spaced from said head end a distance which is selectable and adjustable to accommodate a user of the bed and having a width along the bed length which is a small portion of the length of the bed leaving sufficient space between said bottom end and said bedside post for enabling entry and exit from the bed without movement of said post, and wherein said post comprises there members including two vertical supports secured to said one bed rail, and an arcuate member extending between said supports and terminating in ends attached to respective ones of said supports by means of adjustable telescoping joints for adjusting the height of said post above said one side rail.

3. A bedside grab bar for use with a bed comprising a frame having side rails, head and bottom ends, and legs for supporting the side rails above a floor supporting the bed, said grab bar having the shape of an inverted U including two vertical legs removably attachable to one of said rails, said grab bar having a width which is a small portion of the length of the bed allowing mounting of said grab bar on said frame near the head end thereof while leaving sufficient space between the bottom end and said grab bar for enabling entry and exit from the bed without movement of the grab bar, and including C-clamp means for securing the grab bar to said one rail, the vertical legs of said grab bar extending through said clamp means for releasingly securing said legs to said one rail and extending downwardly past said one rail and having ends for resting on and supported by the floor.

4. A bedside grab bar for use with a bed comprising a frame having side rails, head and bottom ends, and legs for supporting the side rails above a floor supporting the bed, said grab bar having the shape of an inverted U including two vertical legs removably attachable to one of said rails, said grab bar having a width which is a small portion of the length of the bed allowing mounting of said grab bar on said frame near the head end thereof while leaving sufficient space between the bottom end and said grab bar for enabling entry and exit from the bed without movement of the grab bar, and wherein said grab bar comprises three members including two vertical supports securable to said one bed rail, and an arcuate member extending between said supports and terminating in ends attached to respective ones of said supports by means of adjustable telescoping joints for adjusting the height of said grab bar above said one side rail.

5. A bedside grab bar for use with a bed comprising a frame having side rails, head and bottom ends, and legs for supporting the side rails above a floor supporting the bed, said grab bar having the shape of an inverted U including two vertical legs removably attachable to one of said rails, said grab bar having a width which is a small portion of the length of the bed allowing mounting of said grab bar on said frame near the head end thereof while leaving sufficient space between the bottom end and said grab bar for enabling entry and exit from the bed without movement of the grab bar, and wherein said grab bar comprises three members including two vertical rods securable to said one bed rail, and an arcuate member extending between said rods and terminating in vertical tubings for telescoping onto and releasably attaching to respective ones of said rods.

* * * * *